US005595499A

United States Patent [19]

Zander et al.

[11] Patent Number: 5,595,499

[45] Date of Patent: Jan. 21, 1997

[54] COAXIAL CONNECTOR HAVING IMPROVED LOCKING MECHANISM

[75] Inventors: Hans-Joachim Zander, Schifferstadt; Dieter Bozzer, Mannheim; Stefan Martin, Bensheim, all of Germany

[73] Assignee: The Whitaker Corporation, Wilmington, Del.

[21] Appl. No.: 634,074

[22] Filed: Apr. 17, 1996

Related U.S. Application Data

[63] Continuation of Ser. No. 534,133, Sep. 26, 1995, abandoned, which is a continuation of Ser. No. 282,380, Jul. 29, 1994, abandoned.

[30] Foreign Application Priority Data

Oct. 6, 1993 [GB] United Kingdom ..... 9320575

[51] Int. Cl.[6] ..... H01R 13/627

[52] U.S. Cl. ..... 439/352; 439/578

[58] Field of Search ..... 439/345, 350, 439/352–357, 358, 578; 403/322

[56] References Cited

U.S. PATENT DOCUMENTS

| | | | |
|---|---|---|---|
| 3,639,890 | 2/1972 | Stevens et al. . | |
| 3,694,793 | 9/1972 | Concelman . | |
| 3,869,187 | 3/1975 | Bingham | 439/357 X |
| 4,017,139 | 4/1977 | Nelson | 439/352 |
| 4,533,194 | 8/1985 | Boichut et al. | 439/352 X |
| 4,880,393 | 11/1989 | Moji | 439/352 |
| 5,195,905 | 3/1993 | Pesci | 439/352 |

FOREIGN PATENT DOCUMENTS

| | | | |
|---|---|---|---|
| 2045384 | 5/1971 | Germany . | |
| 0727935 | 4/1980 | U.S.S.R. | 439/352 |
| 1339801 | 12/1973 | United Kingdom . | |
| WO92/08259 | 5/1992 | WIPO . | |

*Primary Examiner*—Khiem Nguyen
*Attorney, Agent, or Firm*—Eric J. Groen; Driscoll A. Nina

[57] ABSTRACT

A coaxial connector plug includes an inner insulating housing carrying a coaxial connector pin, where an outer grounding spring is positioned coaxially around the housing. The grounding spring is positioned within a sleeve member and a locking spring and outer sleeve are axially moveable between positions where locking arms of the locking spring are moveable to a position where a front edge of the locking arms is engaged with a corresponding surface of the sleeve member. The locking arms also include a locking projection which will reside in a peripheral groove of a mating jack connector when fully inserted thereto.

12 Claims, 8 Drawing Sheets

COAXIAL CONNECTOR HAVING IMPROVED LOCKING MECHANISM

This application is a continuation of application Ser. No. 08/534,133 filed Sep. 26, 1995, now abandoned, which is a continuation of 08/282,380 filed Jul. 29, 1994 now abandoned.

BACKGROUND OF THE INVENTION

1. Field of the Invention

The subject invention relates to coaxial connectors and to locking mechanisms to retain counterpart jacks and plugs together.

2. Description of the Prior Art

It is common in coaxial connector pairs comprised of plugs and jacks to include some kind of locking mechanism between the cooperating pairs to retain the two connectors together. One such method is the so called "Bayonet" style which includes a rotatable cap generally found on the plug which contains an axial entry slot on the inner diameter, of the rotatable cap which is continuous with a slot which extends at an acute angle relative to the transverse direction. The mating jack includes on its outer diameter a circular lug which is slidably receivable into the axial portion of the slot of the cap, whereupon the cap can be rotated and the lug is presented in the angled portion of the slot, causing the two corresponding connector parts to be brought together. Another version includes a rotatable cap similar to that described above however has a continuous thread on its internal diameter which is threadable onto associated threads on the outside diameter of the jack whereby the two connector parts can be screwed together. However in either case, these types of connectors tend to be very expensive and time consuming to manufacture.

SUMMARY OF THE INVENTION

It is therefore an object of the invention to provide a design of coaxial connector which is easier to assemble.

It is a further object of the invention to provide a more cost-effective design of coaxial connector system.

BRIEF DESCRIPTION OF THE DRAWINGS

FIG. 13 shows an exploded view of the entire subassembly;

DETAILED DESCRIPTION OF THE PREFERRED EMBODIMENT

Figure 1:
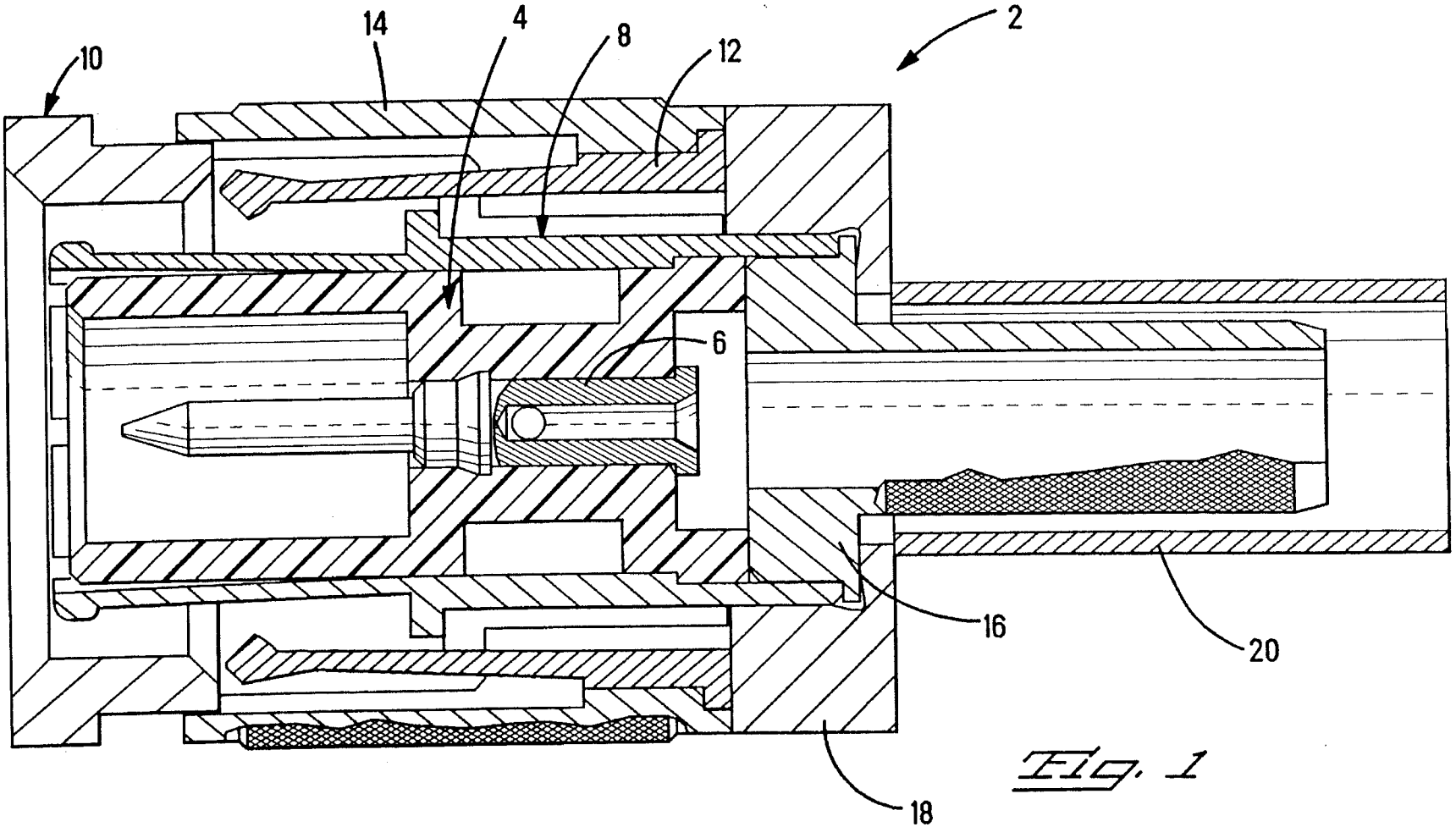
FIG. 1 is a cross-sectional view through an axial center line of the subject invention.

With reference first to FIG. 1, the coaxial connector shown is a plug connector generally shown at 2 which includes an inner insulative housing 4 carrying a conductive pin member 6 coaxially positioned within the housing 4. The outer grounding spring is shown at 8 and surrounds the insulative housing portion 4 coaxially thereof. The assembled housing and grounding spring 8 are assembled within a stopping sleeve member 10, and an assembly of a locking spring 12 and outer sleeve 14 can move axially relative to the sleeve member 10 for locking a mating connector, as will be described in greater detail herein. A crimp end member 16 is positioned within an inner diameter of the grounding spring 8 and is held in position by a locking washer 18 positioned against an outer diameter of the crimping spring 8. A locking sleeve 20 is positioned over the crimp end member 16 to crimp the braid of a coaxial cable in conductive engagement as will be described in greater detail herein.

Figure 2:
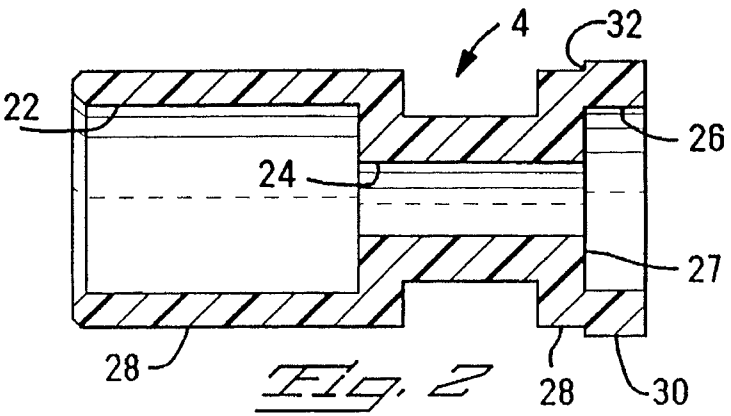
FIG. 2 is a cross-sectional view of the inner insulative housing.

With reference now to FIG. 2, the inner insulative housing 4 includes a front cavity at 22 which is continuous with a pin receiving passageway 24, then terminating into an enlarged bore at 26, having a rearwardly facing surface 27. An outer diameter of the housing is shown at 28 with an enlarged diameter portion 30 which forms a stepped shoulder at 32.

Figure 3:
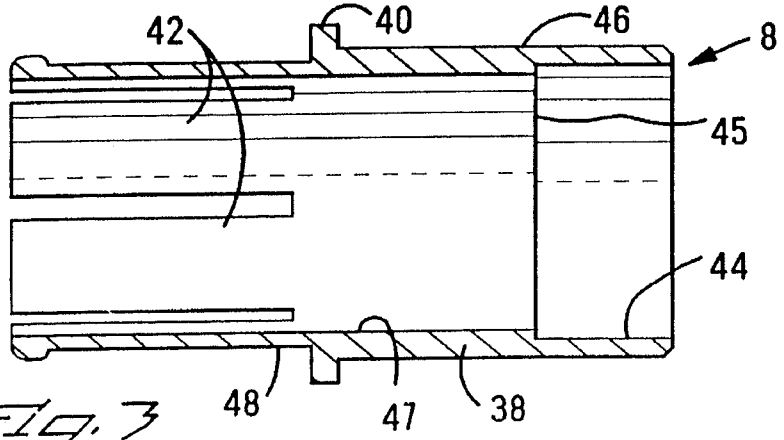
FIG. 3 is a cross-sectional view of the outer grounding spring.

With reference now to FIG. 3, the grounding spring 8 is formed as a generally tubular cylinder portion at 38 having a centrally positioned flange at 40 with individual spring members 42 at a front edge thereof, and a counterbored section at the rear shown at 44, forming a rear edge 45. The spring has an outer rear surface at 46, an inner diameter 47, and a somewhat lesser diameter at surface 48.

Figure 5:
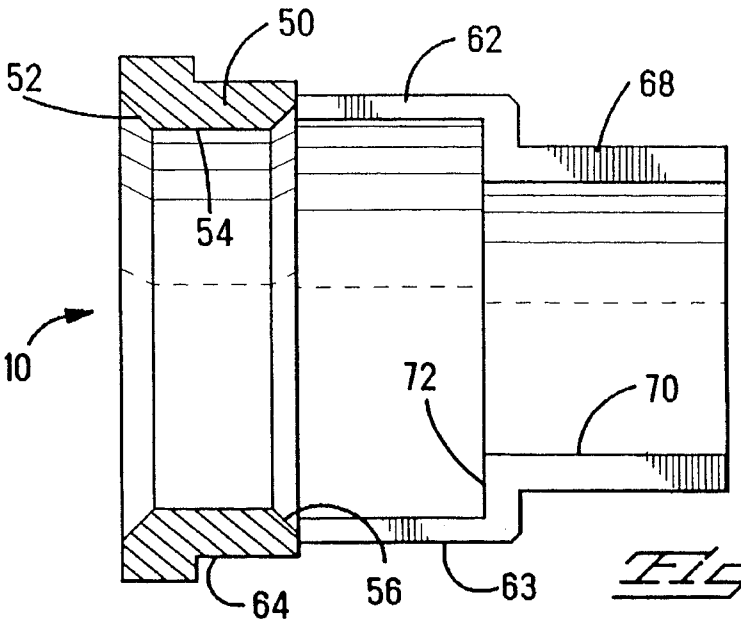
FIG. 5 is a cross-sectional view through lines 5—5 of FIG. 4.
Figure 4:
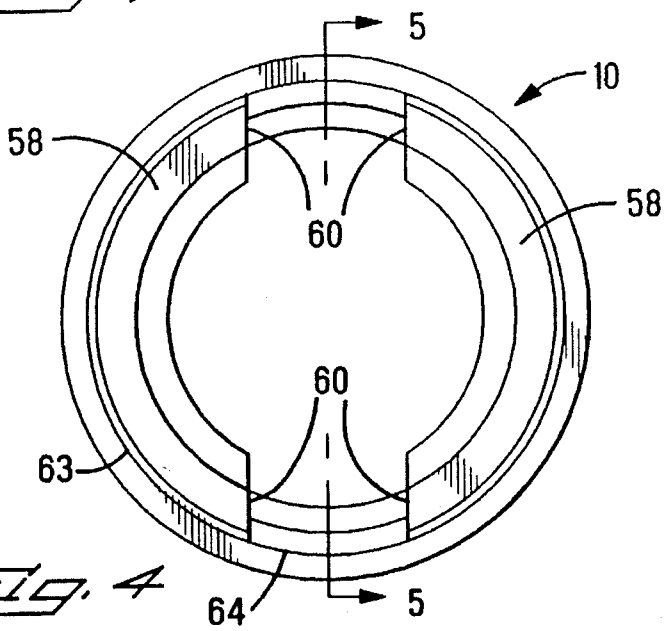
FIG. 4 is an end view of the outer stopping sleeve.

With reference now to FIGS. 4 and 5, the outer stopping sleeve 10 is shown having a front continuous ring at 50 having a chamfered lead-in surface at 52, an internal diameter at 54, and a rear locking surface at 56. As shown best in FIG. 4, arcuate extension members 58 extend from opposite sides of the continuous ring portion 50 and are separated by slots at 60. The extension portions 58 are formed with a portion at 62 having an outer diameter 63 which is the same as the outer diameter at 64, which is best shown in FIG. 4. Portions 62 extend into constricted sections at 68 having an inner diameter at 70 forming a forwardly facing shoulder 72.

Figure 6:
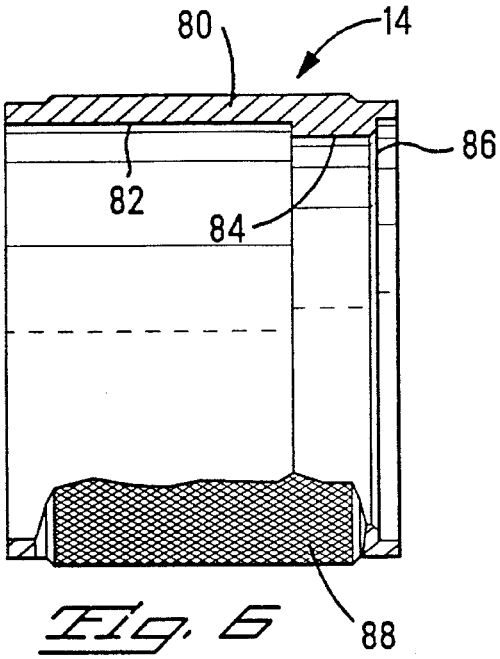
FIG. 6 is a cross-sectional view through the outer sleeve.
Figure 7:
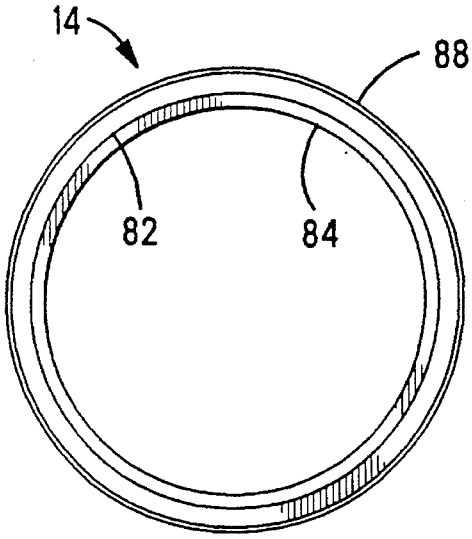
FIG. 7 is an end view of the sleeve shown in FIG. 6.

With respect now to FIGS. 6 and 7, the outer sleeve 14 is shown as a cylindrical portion 80 having an inner diameter at 82 and a stepped down diameter at 84. Rearwardly of the diameter portion 84 is a cylindrical groove at 86. The outer surface of the sleeve 14 is knurled at 88 to provide a surface which is easier to handle.

Figure 8:
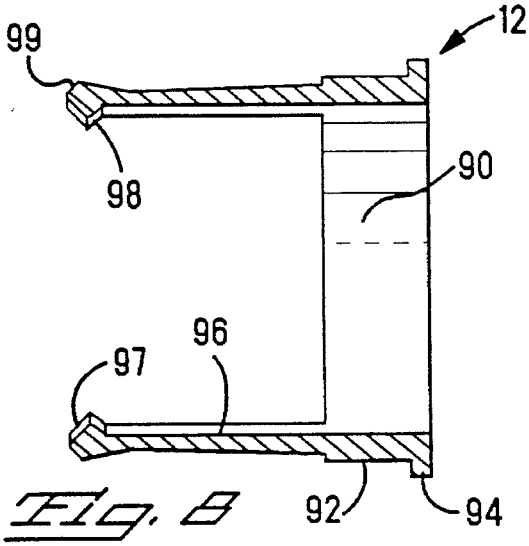
FIG. 8 is a cross-sectional view through the locking sleeve.
Figure 9:
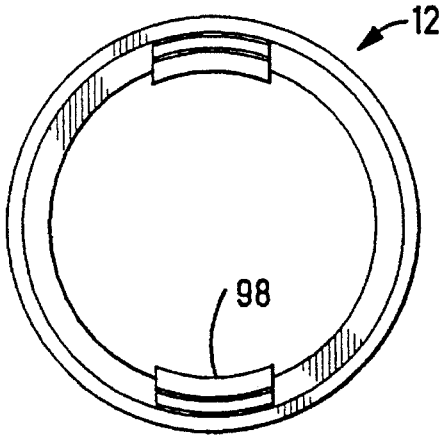
FIG. 9 is an end view of the locking sleeve of FIG. 8.
Figure 10:
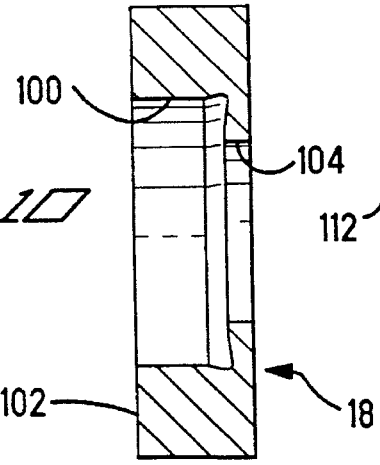
FIG. 10 is a cross-sectional view of a locking washer.
Figure 11:
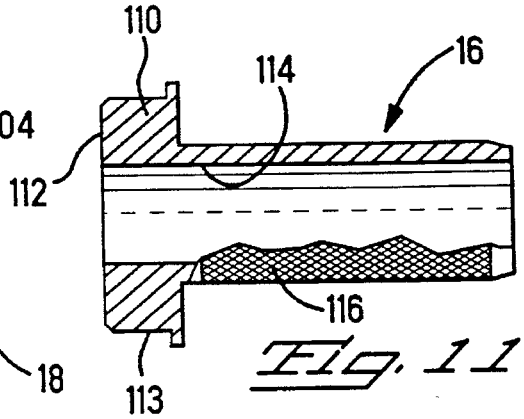
FIG. 11 is a cross-sectional view a crimp end member.

As shown in FIGS. 8 and 9, the locking spring 12 is shown as including a continuous ring 90 having an outer diameter at 92 and a flange section at 94. Locking spring arms 96 extend forwardly from the continuous ring portion 90 and have camming lead-in surfaces 97, engaging sections at 98 adjacent to the front ends of the arms 96, and stop surfaces at 99. As shown now in FIG. 10, the locking washer 18 has a through bored section at 100, a mating face at 102 and a rear bore section at 104. As shown in FIG. 11, the crimp end member 16 is shown including a forward ring section 110 having a front face 112 and outer diameter 113. The crimp end member also includes an inner diameter at 114 and an outer knurled diameter at 116.

Figure 12:
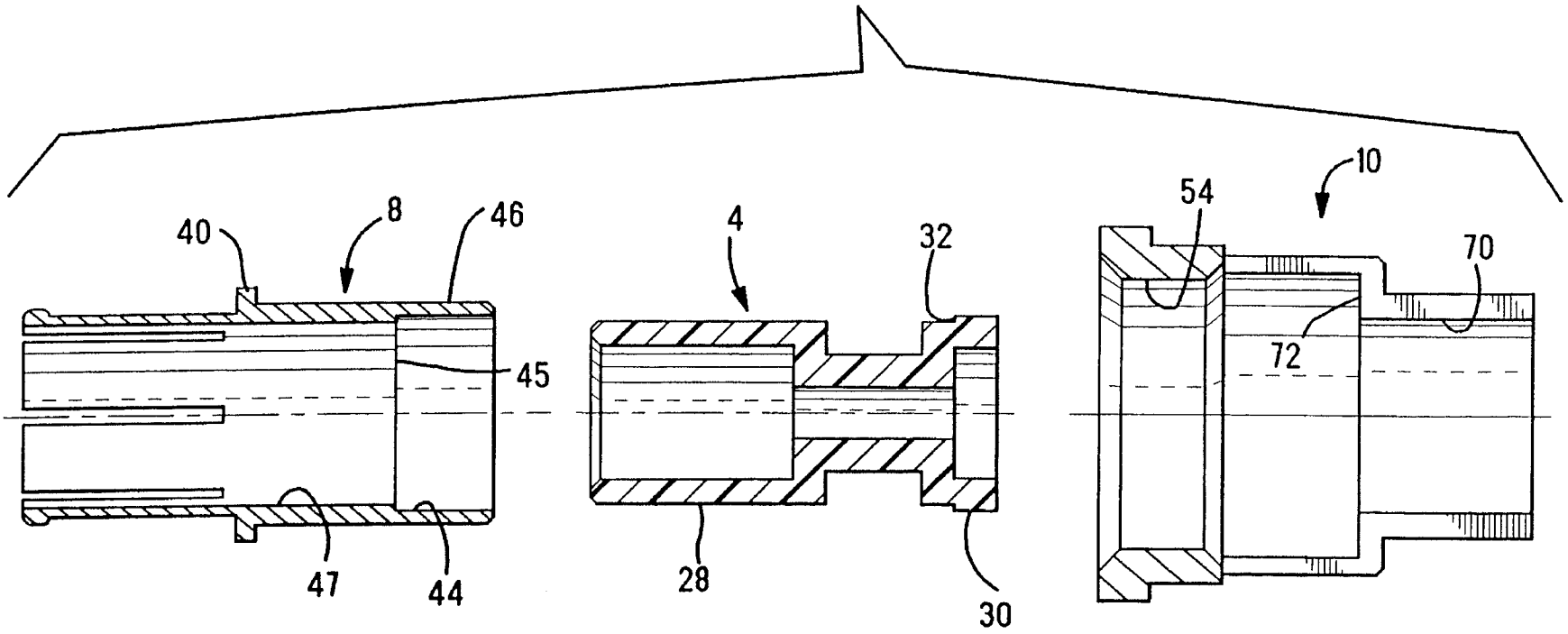
FIG. 12 shows an exploded view of the inner housing, the ground spring and the outer sleeve.

With reference now to FIG. 12, the assembly of the coaxial plug member 2 will be described in greater detail. The insulative housing member 4 can be slidably received into the grounding spring member 8 with the outer diameter 28 of the housing 4 sliding against the inner diameter 47 of the grounding spring. The inner housing 4 is inserted into the grounding spring to a position where the stepped portion 32 engages the rear edge 45. The sleeve member 10 can now be slidably received over the outer grounding spring 8 with the cooperation of the inner diameter 70 sliding against the outer surface 46 until the front facing surface 72 engages the flange portion 40.

It should be appreciated that the assembly of the components shown in FIG. 12 appear in FIG. 13 on the leftward most side, poised for receiving the outer sleeve 14, the locking spring 12, the crimp end member 16 and the locking washer 18. The locking spring 12 and outer sleeve 14 are first assembled together by positioning the interference fit surfaces 92 and 84 in engagement such that the outer flange portion 94 is positioned within groove 86. The assembly of these two components can now be slidably received over the sleeve member 10 such that the inner diameter 82 of the outer sleeve 14 is slidably received over the outer diameters 63, 64, and with the locking arms 96 being received within the slots 60 of the outer sleeve member 10. It should be appreciated that the outer sleeve 14 and the locking spring 12 cooperate together as one unitary assembly, and is profiled relative to the outer sleeve member 10 for axial movement between the parts.

With the outer sleeve 14 and locking spring 12 assembled over the sleeve member 10, the crimp end member 16 is now positioned within an end of the grounding spring 8, such that the outer diameter 113 is positioned within the inner diameter 44 of the grounding spring member 8. The locking washer 18 is now positioned over the end of the crimp end member 16 such that inner diameter 100 is interferingly fit with outer surface 46 of the grounding spring 8 to retain the crimp end member 116 in place. It should be appreciated that the locking washer 18 has a dual function, first retaining the crimp end member 16 in position, and providing a rearward stop for the assembly of the outer sleeve 14 and the locking spring 12, as will be described in greater detail herein.

Figure 14:
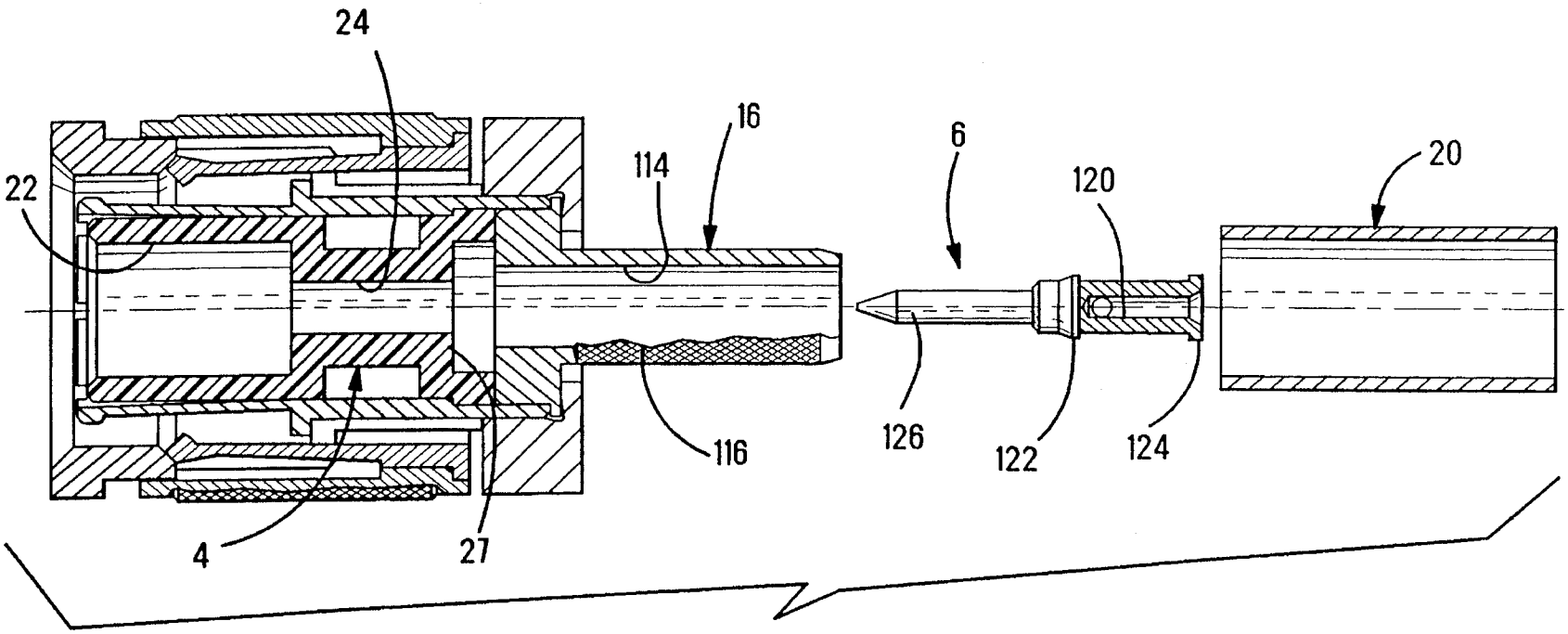
FIG. 14 shows a view similar to that of FIG. 13 together with a contact pin and an outer crimp ring.

With reference now to FIG. 14, the coaxial connector is poised for interconnection to a coaxial cable (not shown) which includes an inner conductor, an inner insulation, a shielding braid, and an outer insulating sheath. The outer sheath is stripped to expose a length of the shielding braid, and the inner insulation is then stripped to expose a shorter length of the coaxial conductor. The coaxial conductor is then positioned within an inner diameter 120 of the coaxial pin 6 and is crimped therein, and the pin is then inserted through the crimp end member 16 and into the passageway 24 of the inner insulative housing 4. The pin member 6 includes a peripheral barb at 122 which is interferingly fit with the passageway 24, and the pin further includes a rear flange section 124 for abutment against a rear face 27 of the housing 4. It should be appreciated that the inner diameter 114 of the crimp end member 16 is large enough to allow the passage of the flange portion 124 of the pin 6 without interference thereof.

The crimping sleeve 20 should now be slidably received over the opposite end of the cable (or should be preassembled over the end of the cable to be crimped to pin 6 if the opposite end of the cable is already terminated) and the outer conductive braid of the coaxial cable can be dressed over the outer diameter 116 of the crimp end member 16 and the crimp sleeve 20 can be crimped to provide a conductive path between the grounding spring 8 and the conductive braid of the coaxial cable.

Figure 17:
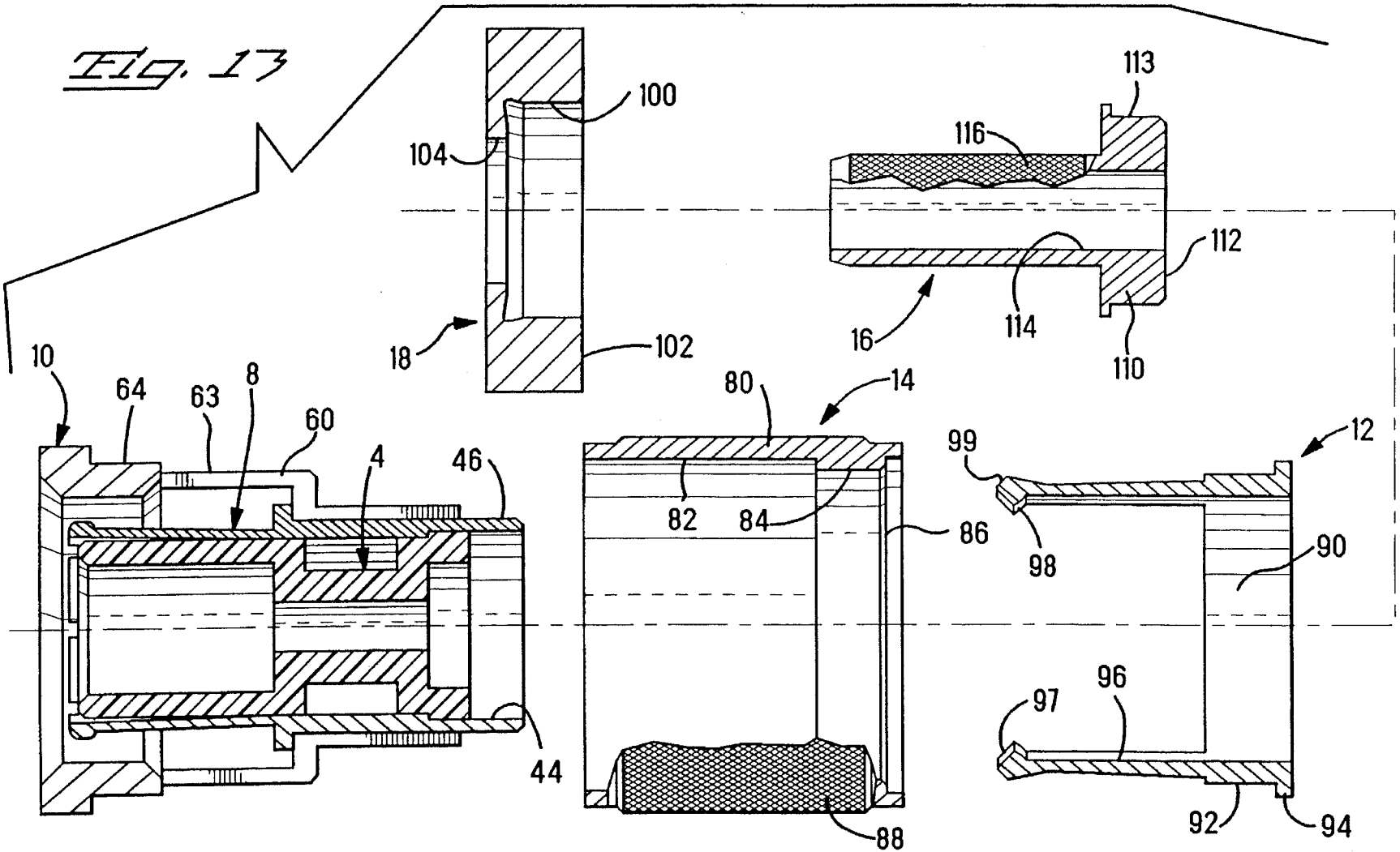
FIG. 17 is a view similar to FIG. 16 showing the coaxial connector at a mated and locked connection.
Figure 15:
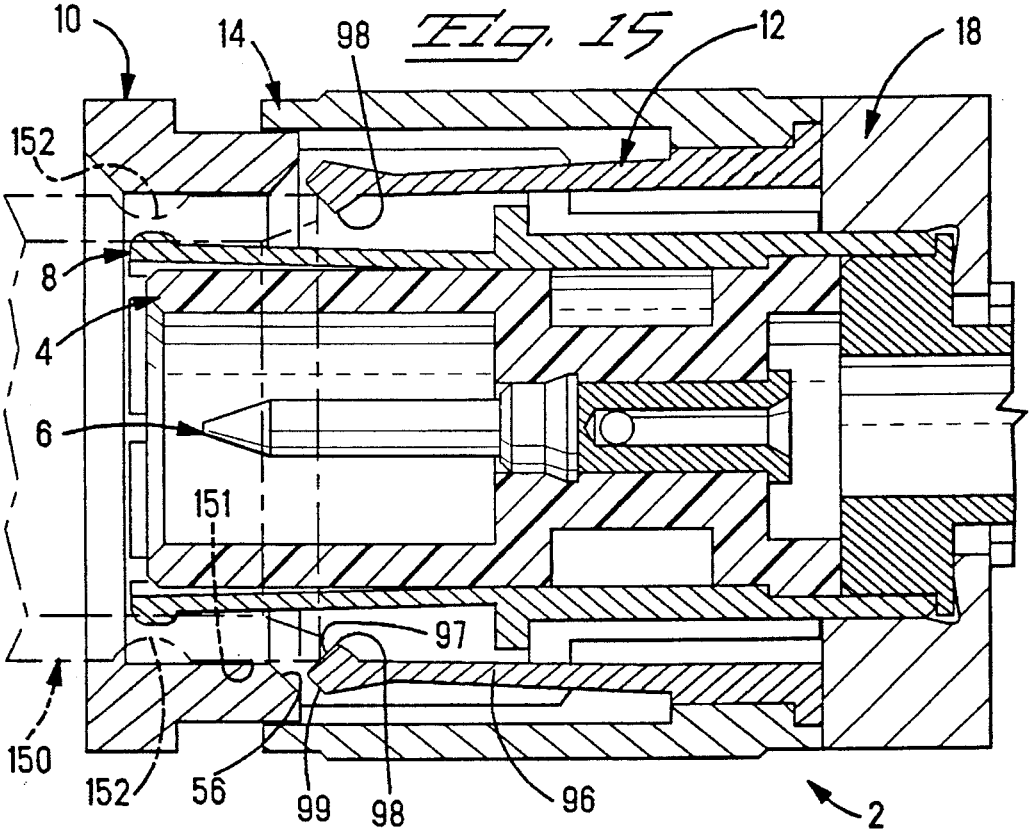
FIG. 15 is a view similar to FIG. 1 showing the coaxial connector at an initial stage of matable connection with a matable connector.
Figure 16:
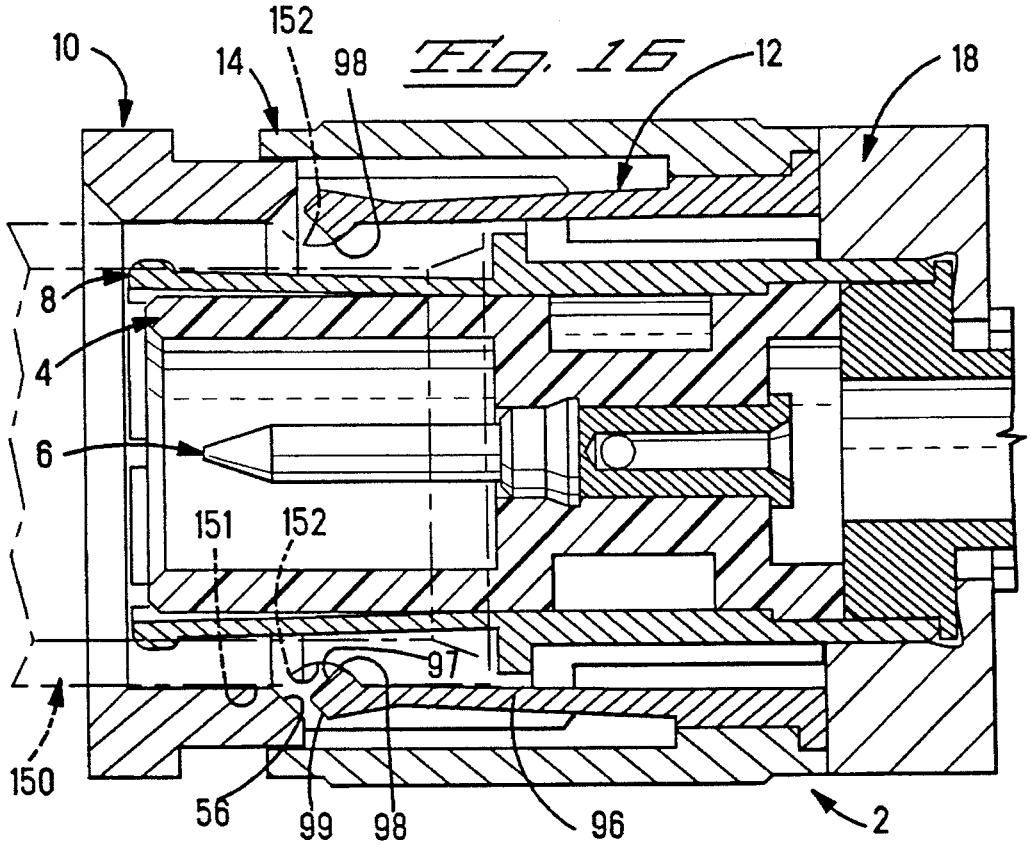
FIG. 16 is a view similar to FIG. 15 showing the coaxial connector at a mated but unlocked or prelocked connection.
Figure 17:
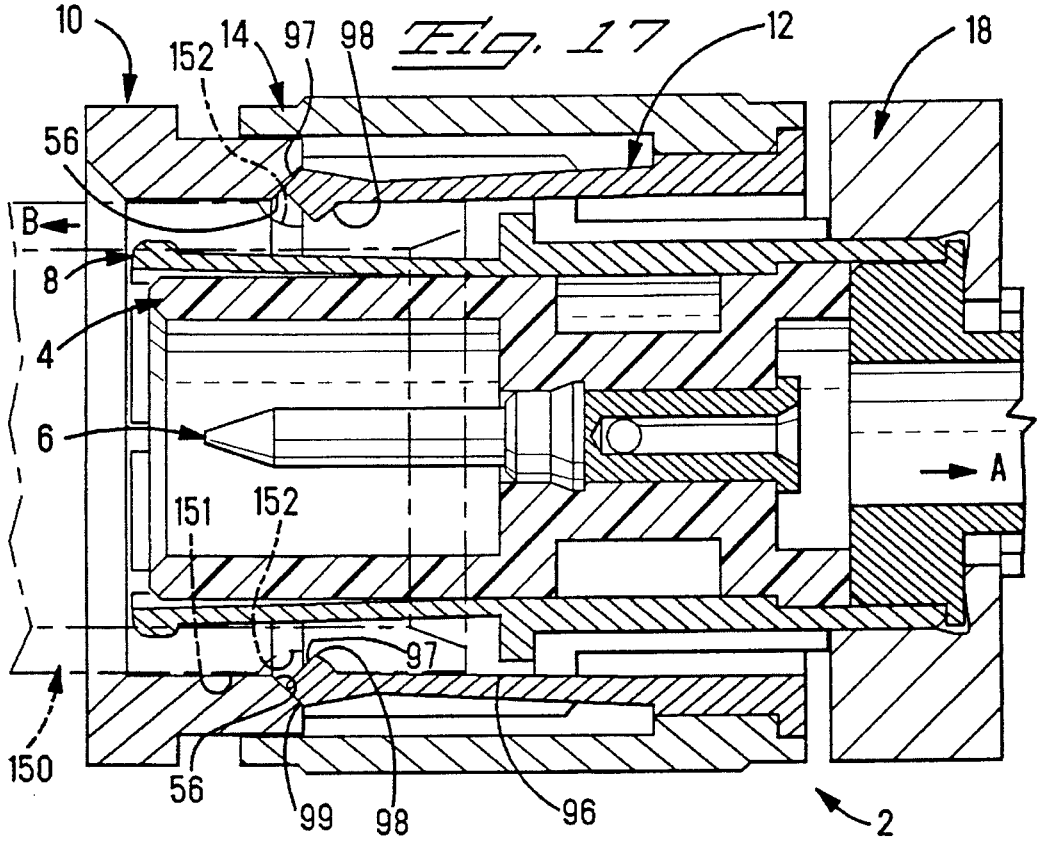
Figure 18:
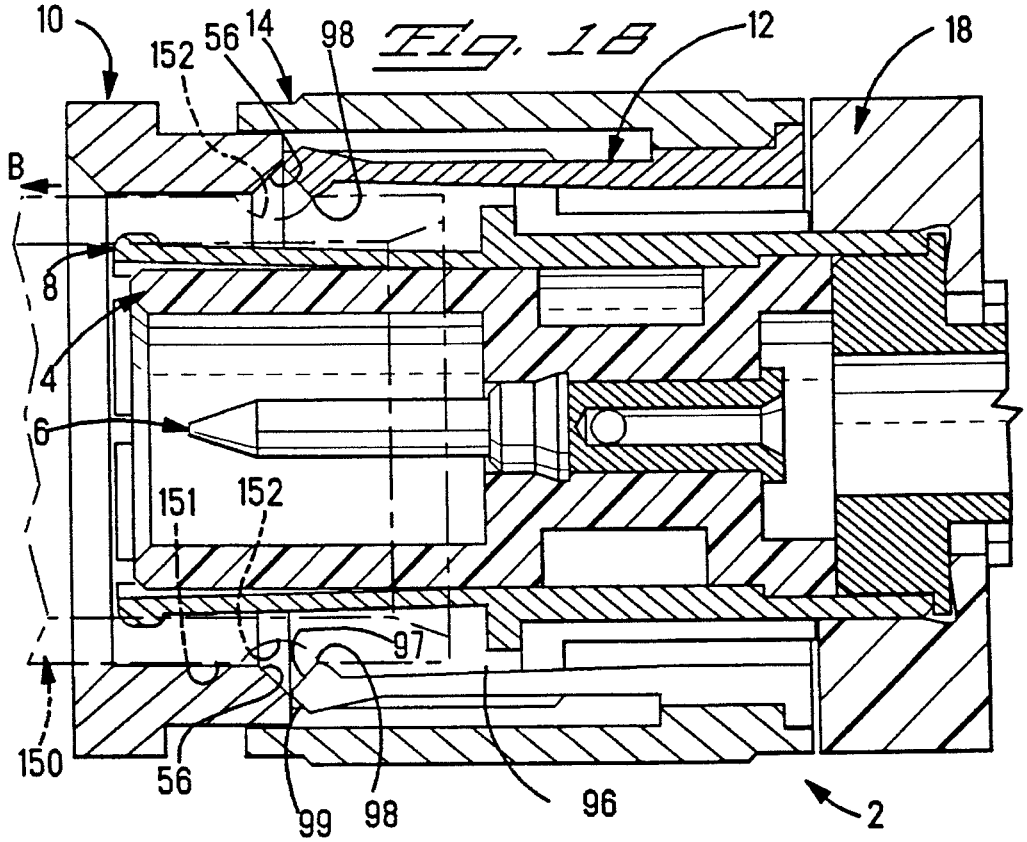
FIG. 18 is a view similar to FIG. 17 showing the coaxial connector at an unlocked condition and being disconnected from the matable connector.

With respect now to FIG. 15, the assembly of the plug member 2 as assembled above can be lockingly interconnected to a corresponding jack member 150. The combination of the locking spring member 12 and outer sleeve 14 are pulled axially rearwardly until they abut the locking washer 18 as shown in FIG. 15. The corresponding jack member 150 is now inserted over the locking spring member 8 to a position where the front of the jack 150 engages the camming surfaces 97 of the locking spring member 12. The locking spring arms 96 will expand outwardly to a position where the engaging sections 98 can slide along an outer surface 151 of the jack member 150. Continued insertion of the jack member 150 causes the engaging sections 98 of the locking arm 96 to snap into a peripheral groove 152 positioned adjacent to the front end of the jack 150. Any pulling forces between the plug connector 2 and jack connector 150, for example forces A and B as shown in FIG. 17, will pull the combination of the locking spring 12 and outer sleeve with the jack in the direction of arrow B to the position where the front surface 99 of the locking spring is abutting against surface 56 of sleeve member 10, preventing disengagement thereof. In the event that disengagement of the two connectors is desired, the combination of locking spring 12 and outer sleeve 14 are pulled to their rearward most position where a pulling force in the direction B can disengage the locking spring arms 96 from the peripheral groove 52.

We claim:

1. A coaxial connector comprising an inner terminal and an outer conductor coaxially positioned relative to the inner terminal, an insulative housing disposed between the inner terminal and outer conductor, a locking element supported by the outer conductor including a stationary member and a movable member movable relative to the outer conductor and the stationary member, spring locking arms provided by the movable member engagable in a peripheral groove of a mating connector when the mating connector is mated with the coaxial connector to latch the connectors in a prelocking condition, and cam engaging surfaces on said spring locking arms and said stationary member engagable with one another when said movable member is moved toward said stationary member thereby locking said spring locking arms within the peripheral groove of the mating connector.

2. A coaxial connector as claimed in claim 1, wherein the stationary member is a sleeve member having slots through which said spring locking arms extend.

3. A coaxial connector as claimed in claim 1, wherein the movable member is an outer sleeve coupled with said spring locking arms.

4. A coaxial connector as claimed in claim 2, wherein said sleeve member includes an open forward ring for receiving the mating connector.

5. A coaxial connector as claimed in claim 4, wherein said open forward ring has one of said cam engaging surfaces in the form of a rearwardly facing cam surface.

6. A coaxial connector as claimed in claim 4, wherein said spring locking arms contain another of said cam engaging surfaces in the form of forwardly facing cam surfaces.

7. A coaxial connector comprising an inner terminal; and outer conductor coaxially positioned relative to the inner terminal; an insulative housing therebetween; and a locking element supported by said outer conductor for locking engagement with a mating connector where the locking element includes a locking spring moveable axially of said outer conductor and carrying spring locking arms which are adapted for engagement in a peripheral groove of the mating connector, the locking element further including a stopping sleeve having a front ring with a locking surface thereupon, where the locking spring has a first position with locking arms clear of the locking surface such that the arms may deflect during mating and demating with the mating connector and a second position where the locking arms cooperate with the locking surface to prevent deflection of the arm such that the arm remains engaged in the peripheral groove of the mating connector; the coaxial connector being characterized in that a pair of arcuate extension members extend from the front ring defining slots therebetween to form a stopping sleeve and the locking spring has a base from which the springs extend, the locking spring being fitted to the stopping sleeve with the spring arms disposed in the slots and extending toward the ring, the base includes an outer diameter extending outward beyond the arcuate sections with said stopping sleeve being fixed relative the outer conductor and an outer sleeve fitted over the arcuate sections and attached to the locking spring for manipulating the locking spring.

8. The coaxial connector of claim 7, further characterized in that the stopping sleeve is received in a press fit manner by a locking washer that is positioned against the outer conductor thereby captivating the locking spring.

9. The coaxial connector of claim 8, further characterized in that a crimp end member is provided and the locking washer and outer conductor are engaged therewith.

10. The coaxial connector of claim 9, further characterized in that the engagement is established by an interference fit therebetween.

11. The coaxial connector of claim 8, further characterized in that the inner terminal is retained within the insulative housing by way of an interference fit.

12. The coaxial connector of claim 8, wherein a crimp sleeve is provided for fitting about the crimp end member in order to retain a coaxial cable therewith such that an outer braid of the coaxial cable is electrically connected to the outer conductor.

* * * * *